US006875083B2

(12) United States Patent
Gunnell

(10) Patent No.: US 6,875,083 B2
(45) Date of Patent: Apr. 5, 2005

(54) ABRASIVE MEDIA CONTAINMENT BAG

(75) Inventor: John W. Gunnell, Bedford, TX (US)

(73) Assignee: Bell Helicopter Textron, Inc., Fort Worth, TX (US)

( * ) Notice: Subject to any disclaimer, the term of this patent is extended or adjusted under 35 U.S.C. 154(b) by 0 days.

(21) Appl. No.: 10/492,316

(22) PCT Filed: Oct. 17, 2002

(86) PCT No.: PCT/US02/33582

§ 371 (c)(1),
(2), (4) Date: Apr. 12, 2004

(87) PCT Pub. No.: WO03/039973

PCT Pub. Date: May 15, 2003

(65) Prior Publication Data

US 2004/0198188 A1 Oct. 7, 2004

Related U.S. Application Data

(60) Provisional application No. 60/330,344, filed on Oct. 18, 2001.

(51) Int. Cl.[7] ..... B24B 1/00

(52) U.S. Cl. ..... 451/38; 451/75; 451/87; 451/88; 451/89; 451/91; 451/102

(58) Field of Search ..... 451/38, 75, 87, 451/88, 89, 91, 102

*Primary Examiner*—Joseph J. Hail, III
*Assistant Examiner*—Shantese L. McDonald
(74) *Attorney, Agent, or Firm*—James E. Walton

(57) ABSTRACT

An abrasive media containment bag (11) having a bag portion (13), a nozzle fitting (15), a blast fitting (17), and a filter member (19) is disclosed. The abrasive media containment bag (11) allows the surface of an aircraft or aircraft component to be prepared for bonding by using abrasive blasting, without fear of contaminating other aircraft components with the abrasive media. The abrasive media containment bag (11) isolates the area to be treated ande recovers and contains the abrasive media.

20 Claims, 2 Drawing Sheets

ABRASIVE MEDIA CONTAINMENT BAG

This application claims benefit of provisional appln, 60/330,344 filed Oct. 18, 2001.

TECHNICAL FIELD

The present invention relates to abrasive blasting. In particular, the present invention relates to apparatuses for the recovery and containment of the abrasive media.

DESCRIPTION OF THE PRIOR ART

Click studs and other types of fasteners are bonded to the surfaces of aircraft and aircraft components to secure and hold electrical lines, hydraulic lines, and other items in desired locations. If these fasteners become loose, the items they are securing can rub together, against the surface of the aircraft, or against other aircraft components causing significant damage to the item, the aircraft, and/or other aircraft components. The failure of the bond between the fastener and the aircraft can lead to damage and destruction of critical aircraft components, resulting in dangerous flying conditions. Therefore, it is imperative that the bonds between these fasteners and the aircraft are prepared and formed as good as possible.

The current method of preparing the surface of the aircraft for bonding of click studs and other fasteners is hand sanding. Although it is known that abrasive blasting would provide a better surface treatment and preparation, abrasive blasting has been avoided for fear that the abrasive media would contaminate other components on the aircraft, as vacuum containment means are not always available or practical in confined spaces or on aircraft in the field.

SUMMARY OF THE INVENTION

There is a need for an improved method and apparatus for treating and preparing the surfaces of aircraft and aircraft components prior to bonding click studs and other fasteners to the aircraft or aircraft components.

Therefore, it is an object of the present invention to provide an improved method and apparatus for treating and preparing the surfaces of aircraft and aircraft components prior to bonding click studs and other fasteners to the aircraft or aircraft components.

The above objects are achieved by providing an abrasive media containment bag having a bag portion, a nozzle fitting, a blast fitting, and a filter member. The abrasive media containment bag according to the present invention allows the surface of the aircraft or aircraft component to be prepared for bonding by using abrasive blasting, without fear of contaminating other aircraft components with the abrasive media. The abrasive media containment bag isolates the area to be treated and recovers and contains the abrasive media.

The abrasive media containment bag according to the present invention provides significant advantages, including: (1) abrasive blasting can be used to treat and prepare the surface of the aircraft or aircraft component without fear of contaminating other aircraft components with the abrasive media; (2) the containment bag isolates the area to be treated; (3) the containment bag and be quickly and easily installed before use, and removed after use; (4) as a result of using the method of the present invention, the bonds are up to 30% stronger than bonds that were prepared by hand sanding; (5) 99.5% of the abrasive media can be recovered and contained; (6) the manufacturing costs are very low; and (7) the containment bag and the collected abrasive media can be quickly and easily disposed of. Some of the materials removed by the abrasive media, such as paint and primer, are designated as hazardous materials. By utilizing the present invention, these materials can be contained and disposed of properly with the abrasive media.

BRIEF DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

DESCRIPTION OF THE PREFERRED EMBODIMENT

Figure 1:
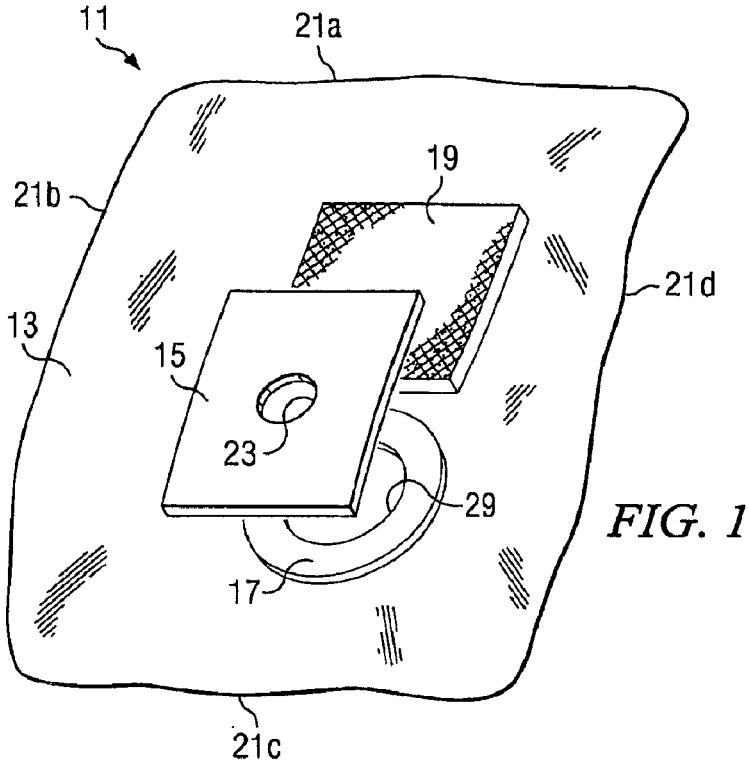
FIG. 1 is a front perspective view of an abrasive media containment bag according to the present invention.
Figure 2:
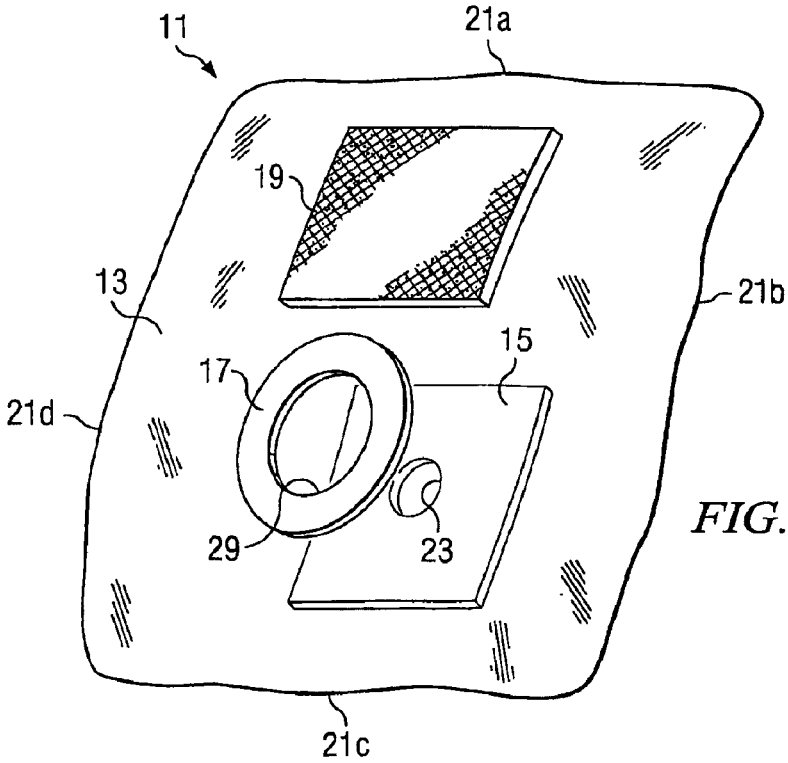
FIG. 2 is a rear perspective view of the abrasive media containment bag of FIG. 1.
Figure 3:
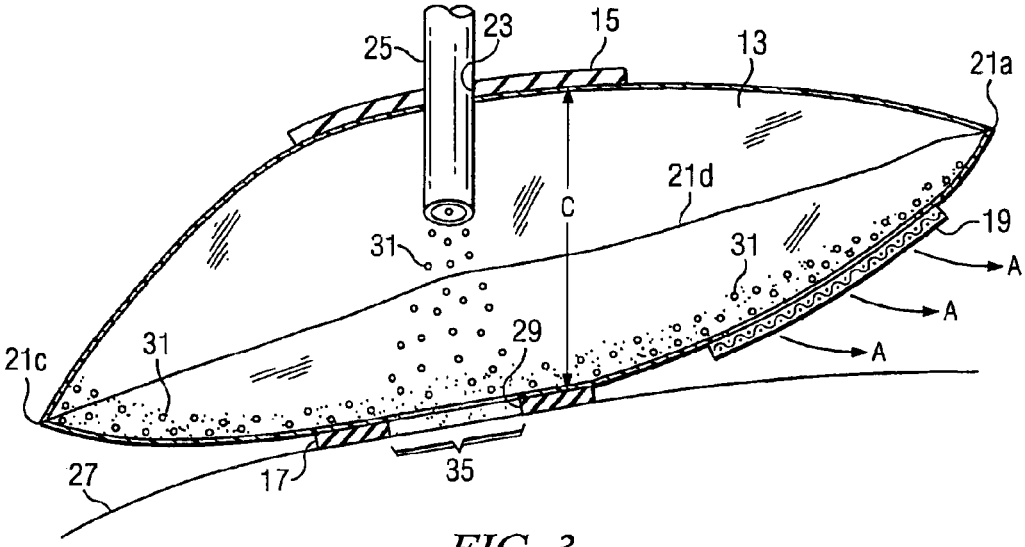
FIG. 3 is a side view in partial cross-section of the abrasive media containment bag of FIGS. 1 and 2 shown in an aircraft surface preparation application.

Referring to FIGS. 1–3 in the drawings, an abrasive media containment bag 11 according to the present invention is illustrated. Containment bag 11 may be used in a wide variety of applications to isolate surfaces to be treated, and recover and contain abrasive media from abrasive blasting operations. Although the present invention is described herein with respect to an abrasive blasting procedure to treat and prepare aircraft surfaces and aircraft components for bonding with click studs and other fasteners and components, it should be understood that the present invention may be used in any abrasive blasting procedure in which it would be desirable to isolate the surface to be treated, and recover and contain the abrasive media. Containment bag 11 includes a bag portion 13, a nozzle fitting 15, a blast fitting 17, and a filter member 19.

Bag portion 13 is preferably made from flexible clear, semi-clear, or otherwise translucent, plastic having a thickness in a range of about 0.003 to 0.006 inches, such as poly-2 film about 0.004 inches thick. When used in an application of abrasive blasting to treat and prepare aircraft surfaces and aircraft components for bonding with click studs and other fasteners, it is preferred that bag portion 13 be about 8.0 inches long and about 7.0 inches wide; however, it will be appreciated that the size and shape of containment bag 11 may varied widely depending upon the application in which the invention is used. For example, if a large surface area or part is being treated, bag portion 13 may be considerably larger. It is also preferred that bag portion 13 form a seamless enclosure; however, bag portion 13 may include seams, such as seams 21*a*, 21*b*, 21*c*, and 21*d*. If bag portion includes seams 21*a*, 21*b*, 21*c*, and 21*d*, it is preferred that seams 21*a*, 21*b*, 21*c*, and 21*d* be sealed by bonding, heat-sealing, gluing, sewing, or other appropriate means, provided that seams 21*a*, 21*b*, 21*c*, and 21*d* prevent the chosen abrasive media 31 from escaping bag portion 13. In the preferred application, abrasive media 31 is 220 grit aluminum oxide.

Nozzle fitting 15 is a reinforced portion of bag portion 13, and is preferably centrally located on the front surface of bag portion 13. Nozzle fitting 15 may be integral with bag portion 13, or may be a separate member that is connected to bag portion 13. In cases where nozzle fitting 15 is a separate member connected to bag portion 13, it is preferred that nozzle fitting 15 be made of rubberized abrasive masking tape, such as the tape sold by the Anchor company as model BT100, 3M 500 stripping tape, or other similar material. The rubberized abrasive masking tape absorbs the impact of the abrasive media and provides a seal as explained below. The rubberized abrasive masking tape preferably includes adhesive on at least one surface that facilitates connection of nozzle fitting 15 to the exterior front surface of bag portion 13. In cases where nozzle fitting 15 is integral with bag portion 13, nozzle fitting 15 may be the same thickness as bag portion 13, or may be slightly thickened, if additional stiffness in the area of nozzle fitting 15 is desired.

Nozzle fitting 15 includes a nozzle aperture 23 that is adapted to sealingly receive a conventional blast nozzle 25 of a from a conventional blasting apparatus (not shown). Nozzle aperture 23 may be a circular, or other suitably shaped hole, or one or more slits, such as an X-shaped slit, in nozzle fitting 15. In any case, the size of nozzle aperture 23 should be such that a seal is formed between nozzle fitting 15 and blast nozzle 25, when blast nozzle 25 is inserted through nozzle aperture 23. Such a seal prevents abrasive media 31 from escaping around nozzle aperture 23. For example, nozzle aperture 23 would have a diameter in the range of about 0.312 to 0.350 inches to sealingly receive a blast nozzle having an outside diameter of about 0.375 inches. In cases where nozzle fitting 15 is a separate member connected to bag portion 13, bag portion 13 includes an appropriately sized aperture over which nozzle fitting 15 is disposed. Although containment bag 11 has been illustrated with a square nozzle fitting 15 and a circular nozzle aperture 23, it should be understood that nozzle fitting 15 and nozzle aperture 23 may be configured in other geometrical shapes, as other geometrical shapes may be more conducive for receiving, supporting, and sealing blast nozzles 25 having other shapes.

Blast fitting 17 is a reinforced portion of bag portion 13, and is preferably centrally located on the rear surface of bag portion 13. Blast fitting 17 may be integral with bag portion 13, or may be a separate member that is connected to bag portion 13. In cases where blast fitting 15 is a separate member connected to bag portion 13, it is preferred that blast fitting 17 be made rubberized abrasive masking tape, such as the tape sold by the Anchor company as model BT100, 3M 500 stripping tape, or other similar material. Such rubberized masking tape is preferred because it absorbs the impact of the abrasive media and prevents blast fitting 17 from wearing out. It is preferred that the rubberized masking tape include an adhesive that does not leave a residue on the surface once blast fitting 17 is removed. If blast fitting 17 does not have adhesive on both sides to facilitate bonding to both bag portion 13 and aircraft surface 27, then a separate adhesive, such as double-sided tape or glue may be used to facilitate connection of blast fitting 17 to the exterior rear surface of bag portion 13. In cases where blast fitting 17 is integral with bag portion 13, blast fitting 17 may be the same thickness as bag portion 13, or may be slightly thickened if additional stiffness in the area of blast fitting 15 is desired.

It is preferred that blast fitting 17 be located on the rear surface of bag portion 13 such that blast fitting 17 and nozzle fitting 15 are aligned with each other, as is best seen in FIG. 3. This configuration allows for a clearance C between nozzle fitting 15 and blast fitting 17 of about 4.0 inches when containment bag 11 is in use. Blast fitting 17 includes a blast aperture 29 that is adapted to isolate and surround the area to be treated. It will be appreciated that the size and shape of blast fitting 17 and the size and shape of blast aperture 29 may vary depending upon the desired application and surface to be treated. Although containment bag 11 has been illustrated with a circular blast fitting 17 and a concentric circular blast aperture 29, it should be understood that blast fitting 17 and blast aperture 29 may be configured in other shapes and patterns, as other shapes and patterns may be more conducive for treating surfaces in other applications. For example, if a fastener has a square base that is to be bonded to aircraft surface 27, it may be desirable that blast aperture 29 be square in shape; and if a part has a hatch pattern, it may be desirable to treat the surface to be bonded with a corresponding hatch pattern.

Filter member 19 is preferably located on the same surface of bag portion 13 as blast fitting 17, and is sealingly attached to bag portion 13 by suitable means, such as by bonding, sewing, or gluing. It is preferred that filter member 19 be capable of filtering 99.5% or more of abrasive media 31 and releasing about 4.0 to 6.0 cubic feet of air per minute dispensed by the blasting device along with abrasive media 31. In the preferred embodiment, filter member 19 is a 1.0 micron filter material about 0.125 inches thick and about 4.5 inches square. The passing of air through filter member 19 is represented in FIG. 3 by arrows A. Although containment bag 11 has been illustrated with a square filter member 19, it should be understood that filter member 19 may be configured in other shapes, as other shapes may be more conducive for filtering abrasive media 31 in various other applications. In addition, it should be understood that additional filter members may be used in certain applications, and that such additional filter members may be of the same capacity or of different capacities than filter member 19. Indeed, the filtration of abrasive media 31 may be performed in multiple stages.

In operation, a protective sheet (not shown) is removed from the exterior surface of blast fitting 17 to expose the non-residue adhesive. Blast fitting 17 is then placed over an area 35 of surface 27 to be treated, where blast fitting 17 is secured in place by the adhesive. Then, nozzle 25 is inserted through nozzle aperture 23, where nozzle 25 is sealingly held in place, preferably by a press fit. Once nozzle 25 is installed, the abrasive blasting treatment process is carried out in a conventional manner, with bag portion 13 capturing and collecting the abrasive media. After the blasting treatment is completed, blast fitting 17 is removed from surface 27 and containment bag 11 is discarded or otherwise disposed of. Then a click stud or other fastener can be bonded to the treated surface 27 in a conventional manner.

Figure 4:
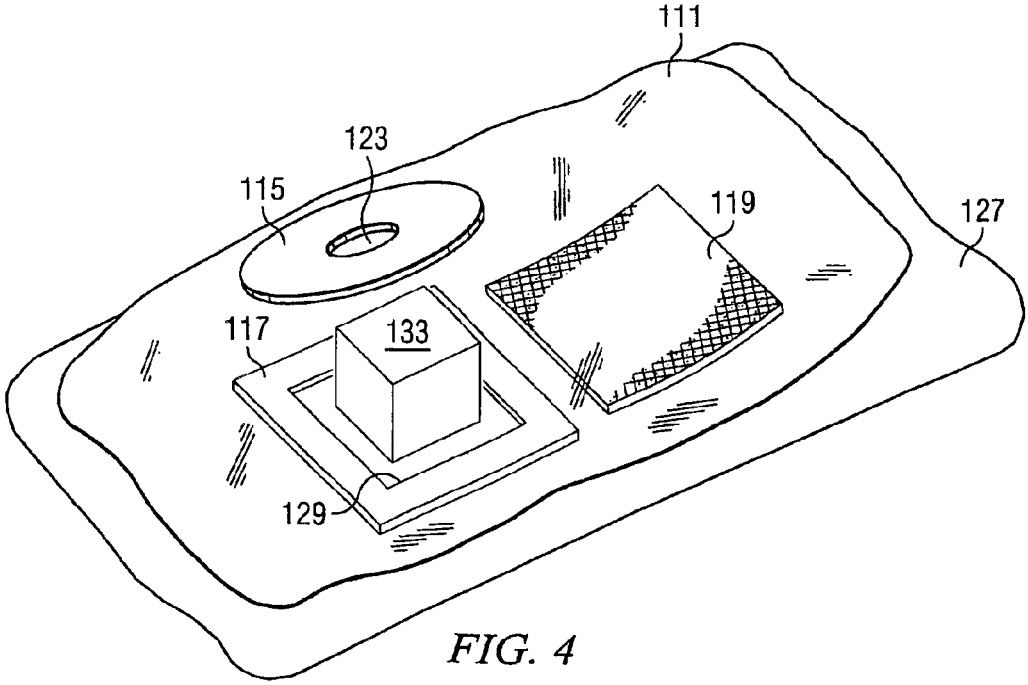
FIG. 4 is a perspective view of the abrasive media containment bag according to the present invention shown in a three-dimensional application.

Although containment bag 11 has been shown and described primarily with respect to treating flat surfaces, it should be understood that the present invention may be used to enclose and treat three-dimensional objects. Referring now to FIG. 4 in the drawings, an abrasive media containment bag 111 is shown in a three-dimensional application. As with containment bag 11, containment bag 111 includes a bag portion 113, a nozzle fitting 115, a blast fitting 117, and a filter member 119. Nozzle fitting 115 includes a nozzle aperture 123, and blast fitting 117 includes a blast aperture 129.

In this application, both blast fitting 117 and blast aperture 129 are square in shape. This configuration is particularly well suited to allow access to all five sides of three-dimensional object 133 which protrudes outward from a surface 127. As long as object 133 can be placed within bag portion 113, and as long as bag portion 113 can be sealed around object 133, the containment bag 111 can be utilized to isolate, contain, and recover the abrasive media.

It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An abrasive media containment bag comprising:

an enclosed bag portion;

a nozzle aperture passing through the bag portion, the nozzle aperture being adapted to sealingly receive a blast nozzle of an abrasive media blasting device;

a blast aperture passing through the bag portion, the blast aperture being adapted for releasable bonding to a surface to be treated by abrasive media from the abrasive media blasting device; and a filter member disposed on the bag portion, the filter member being adapted to allow air to pass therethrough, but to prevent the abrasive media from passing therethrough;

wherein the bag portion is adapted to capture and contain the abrasive media.

2. The abrasive media containment bag according to claim 1, wherein the nozzle aperture is disposed on a first surface of the bag portion and the blast aperture is disposed on an opposing second surface of the bag portion, such that the nozzle aperture and the blast aperture are substantially aligned with each other when the bag portion is bonded to the surface to be treated.

3. The abrasive media containment bag according to claim 1, further comprising:

a reinforced nozzle fitting disposed on the bag portion;

wherein the nozzle aperture passes through the nozzle fitting.

4. The abrasive media containment bag according to claim 3, wherein the nozzle fitting is integral with the bag portion.

5. The abrasive media containment bag according to claim 3, wherein the nozzle fitting is formed from rubberized abrasive masking tape and is sealingly coupled to the bag portion.

6. The abrasive media containment bag according to claim 1, further comprising:

a reinforced blast fitting disposed on the bag portion;

wherein the blast aperture passes through the blast fitting.

7. The abrasive media containment bag according to claim 6, wherein the blast fitting is integral with the bag portion.

8. The abrasive media containment bag according to claim 6, wherein the blast fitting is formed from rubberized abrasive masking tape and is sealingly coupled to the bag portion.

9. The abrasive media containment bag according to claim 1, wherein the filter member is adapted to capture up to about 99.5% of the abrasive media.

10. The abrasive media containment bag according to claim 1, wherein the filter member is adapted to capture up to about 99.5% of the abrasive media and release up to about 4.0 cubic feet of air per minute.

11. The abrasive media containment bag according to claim 1, wherein the filter member is a 1.0 micron filter.

12. The abrasive media containment bag according to claim 1, wherein the blast aperture has one of the following shapes:

(a) circle;

(b) square;

(c) rectangle;

wherein the shape of the blast aperture corresponds to the shape of the surface to be treated.

13. The abrasive media containment bag according to claim 1, wherein the blast aperture forms a pattern of multiple geometric shapes corresponding to the surface to be treated.

14. The abrasive media containment bag according to claim 1, wherein the bag portion and the blast aperture are adapted to enclose a three-dimensional object to be treated.

15. The abrasive media containment bag according to claim 1, wherein the bag portion is formed from flexible plastic having a thickness up to about 0.006 inches.

16. The abrasive media containment bag according to claim 1, wherein the plastic is translucent.

17. A method of treating the surface of an object, the method comprising the steps of:

providing an abrasive media containment bag having a bag portion, a nozzle fitting with a nozzle aperture, a blast fitting with a blast aperture, and a filter member;

enclosing the surface within the containment bag;

securing the containment bag to the object;

inserting an abrasive media blasting device through the nozzle aperture;

treating the surface with abrasive media from the abrasive media blasting device;

capturing the abrasive media with the containment bag; and removing the containment bag from the object.

18. The method according to claim 17, where the surface is a single flat surface.

19. The method according to claim 17, where the surface is a three-dimensional surface.

20. A method of bonding a first object to a second object, the method comprising the steps of:

providing an abrasive media containment bag having a bag portion, a nozzle fitting with a nozzle aperture, a blast fitting with a blast aperture, and a filter member;

enclosing a surface of the first object within the abrasive media containment bag;

securing the blast fitting to the first object;

inserting a blast nozzle of an abrasive media blasting device through the nozzle aperture;

blasting a surface of the first object with abrasive media from the abrasive media blasting device;

capturing the abrasive media with the abrasive media containment bag;

filtering the abrasive media from air with the filter member;

removing the blast fitting from the first object; and bonding the second object to the blasted surface of the first object.

* * * * *